US007432870B2

(12) United States Patent
Teshima et al.

(10) Patent No.: US 7,432,870 B2
(45) Date of Patent: Oct. 7, 2008

(54) PLANAR ANTENNA

(75) Inventors: Masao Teshima, Kunitachi (JP); Hiroshi Shimasaki, Hamura (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 224 days.

(21) Appl. No.: 11/470,919

(22) Filed: Sep. 7, 2006

(65) Prior Publication Data

US 2007/0268185 A1 Nov. 22, 2007

(30) Foreign Application Priority Data

May 16, 2006 (JP) ..... 2006-136977

(51) Int. Cl.
*H01Q 13/10* (2006.01)
*H01Q 9/28* (2006.01)

(52) U.S. Cl. ..... 343/767; 343/770; 343/795

(58) Field of Classification Search ..... 343/767, 343/770, 795, 700 MS

See application file for complete search history.

(56) References Cited

U.S. PATENT DOCUMENTS

2004/0222936 A1* 11/2004 Hung et al. ..... 343/795
2007/0152881 A1* 7/2007 Chan ..... 343/700 MS

FOREIGN PATENT DOCUMENTS

JP 2006-33069 2/2006

* cited by examiner

*Primary Examiner*—Hoang V Nguyen
(74) *Attorney, Agent, or Firm*—Oblon, Spivak, McClelland, Maier & Neustadt, P.C.

(57) ABSTRACT

A planar antenna includes first and second radiation elements. A first partial periphery of the first radiation element and a second partial periphery of the second radiation element face each other at a uniform gap equal to or less than a tenth of the length of the first partial periphery. The first radiation element includes a third partial periphery parallel to a straight line for connecting the both ends of the first partial periphery, a feeding point at a central portion of the first partial periphery, and a slit having an opened end and a closed end. A distance from the feeding point to the opened end along the slit through the closed end is longer than a sum of a half of the first partial periphery and a longer one of the other two partial peripheries.

5 Claims, 12 Drawing Sheets

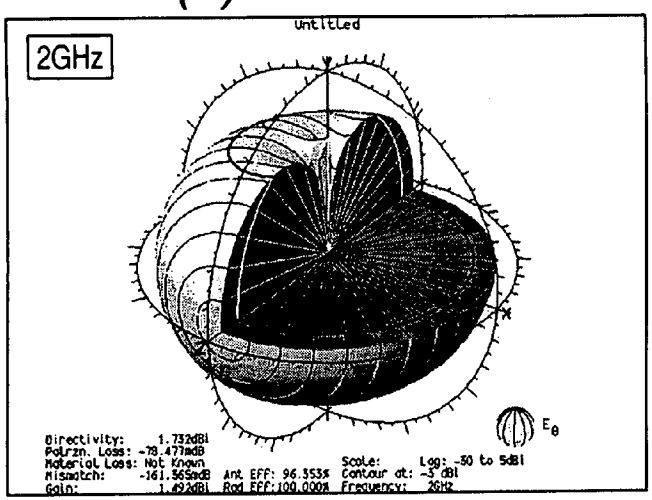
FIG. 5(a)
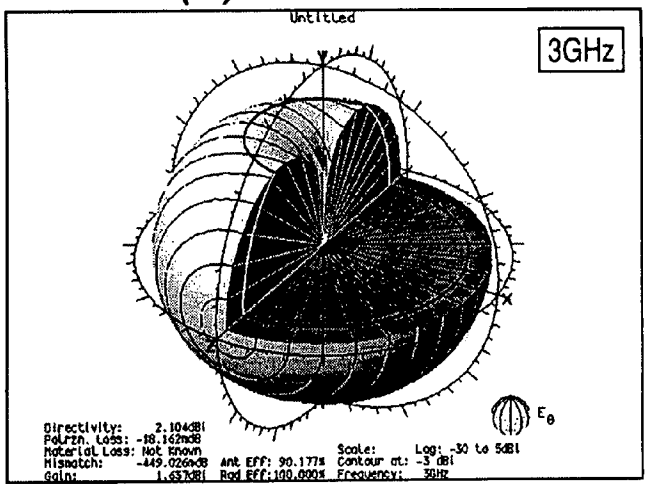
FIG. 5(b)
FIG. 5(c)
FIG. 5(d)

PLANAR ANTENNA

The present disclosure relates to the subject matter contained in Japanese Patent Application No. 2006-136977 filed May 16, 2006, which is incorporated herein by reference in its entirety.

BACKGROUND OF THE INVENTION

1. Field of the Invention

The present invention relates to a planar antenna, and more particularly, to a planar antenna capable of realizing multi-resonance and band widening.

2. Background Art

There is a wideband planar antenna. (For example, see JP-A-2006-033069.) In the planar antenna of JP-A-2006-033069, it is possible to obtain wideband characteristics in which a standing wave ratio is substantially flat between a first resonance frequency of a low frequency side and a second resonance frequency of a high frequency side. The wavelength λ1 of the first resonance frequency of the low frequency side is associated with a dimension A obtained by adding both sides and a short side of a trapezoid of the planar antenna and a relationship of the dimension A=approximately λ1/2 is satisfied.

In the mobile wireless device having the antenna mounted thereon, multi-frequency and band widening are further required. Accordingly, in the planar antenna of JP-A-2006-033069, in order to widen a low frequency band, the dimension A, that is, the length of the sides of the trapezoid, need increase and thus the dimension of the antenna increases.

In the planar antenna of JP-A-2006-033069, the strength against bending is weak. In the arrangement of the coaxial cable, the thickness of the mobile wireless device increases.

SUMMARY OF THE INVENTION

The invention provides a planar antenna capable of realizing band widening without increasing the dimension of the antenna. The invention further provides a planar antenna capable of improving strength against bending.

The invention may provide a planar antenna including: a first radiation element having a planar shape, the first radiation element including a first partial periphery, a third partial periphery, a fourth partial periphery, a fifth partial periphery, a feeding point positioned at a substantially center of the first partial periphery; and a second radiation element having a planar shape, the second radiation element including a second partial periphery having a length at least substantially equal to that of the first partial periphery; wherein the first partial periphery and the second partial periphery face each other at a substantially uniform gap that is substantially equal to or less than a tenth of the length of the first partial periphery; wherein the third partial periphery is substantially parallel to a straight line connecting both ends of the first partial periphery; wherein the fourth partial periphery connects one end of the first partial periphery to one end of the third partial periphery; wherein the fifth partial periphery connects the other end of the first partial periphery to the other end of the third partial periphery; wherein the first radiation element includes a slit having an opened end and a closed end, the opened end opening at a periphery of the first radiation element other than the first partial periphery, the closed end closed within the first radiation element; and wherein a distance from the feeding point to the opened end along the slit through the closed end is longer than a distance obtained by adding a half of the length of the first partial periphery and a longer one of a length of the fourth partial periphery and a length of the fifth partial periphery.

BRIEF DESCRIPTION OF THE DRAWINGS

The present invention may be more readily described with reference to the accompanying drawings, in which:

FIGS. 5(*a*)-(*d*) are simulation views of radiation patterns of a vertically polarized wave of the planar antenna shown in FIG. 1(*a*) according to the first embodiment;

DETAILED DESCRIPTION OF THE PREFERRED EMBODIMENTS

Figure 1A:
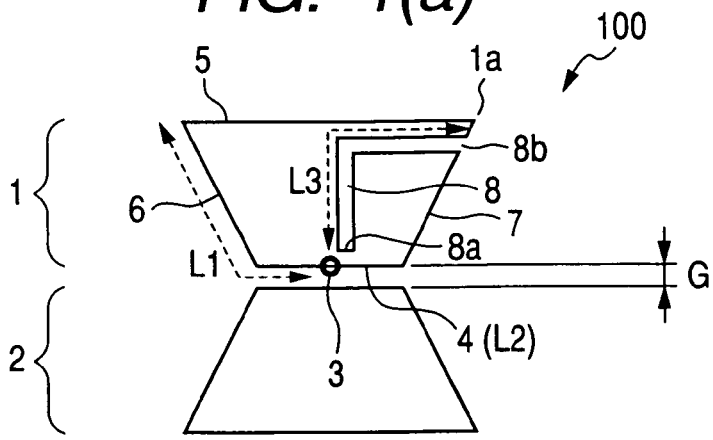
FIGS. 1(*a*)-(*e*) are views showing the configurations of planar antennas according to a first embodiment of the invention.
Figure 1B:
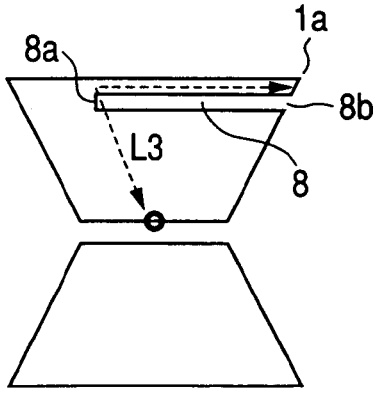
Figure 1C:
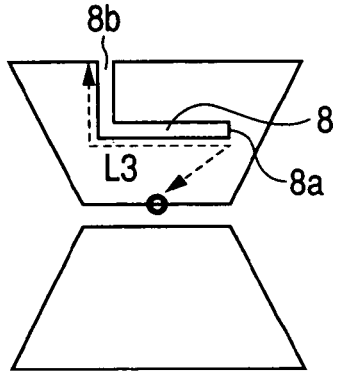
Figure 1D:
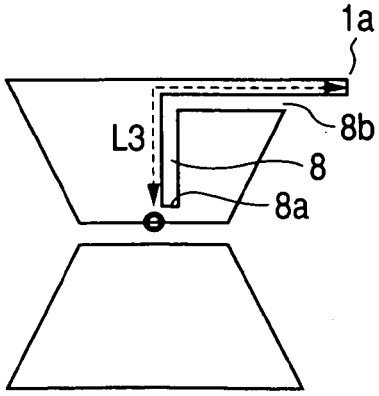
Figure 1E:
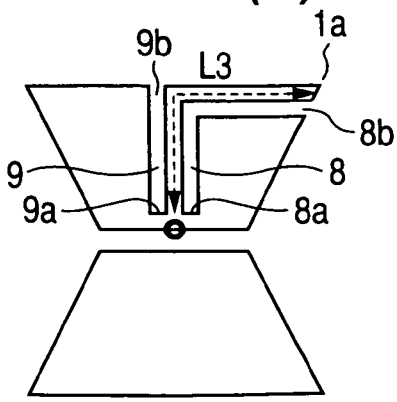

Hereinafter, embodiments of the present invention will be described with reference to the accompanying drawings.

First Embodiment

A first embodiment realizes band widening compared with the background art.

FIGS. 1(*a*)-(*d*) are views showing the configurations of dipole type planar antennas according to the first embodiment. FIGS. 1(*a*), (*b*), (*c*), (*d*) and (*e*) show different slit shapes. The antenna 100 includes a first radiation element 1, a second radiation element 2 and a feeding point 3.

The first radiation element 1 is a trapezoid plane having a short side 4 (first partial periphery) and a long side 5 (third partial periphery) which are parallel sides of the trapezoid, a side 6 and a side 7. The feeding point 3 is connected to a central portion of the short side 4 of the first radiation element 1 to supply power. The first radiation element 1 has a slit 8 which is the characteristic of the first embodiment. The second radiation element 2 has the same shape as the first radiation element 1 except the slit 8, and the short side 4 of the first radiation element 1 and the short side (second partial periphery) of the second radiation element 2 face each other in parallel at a minute gap G. The length of the short side of the second radiation element 2 may be larger than that of the short side 4 of the first radiation element 1.

Figure 2:
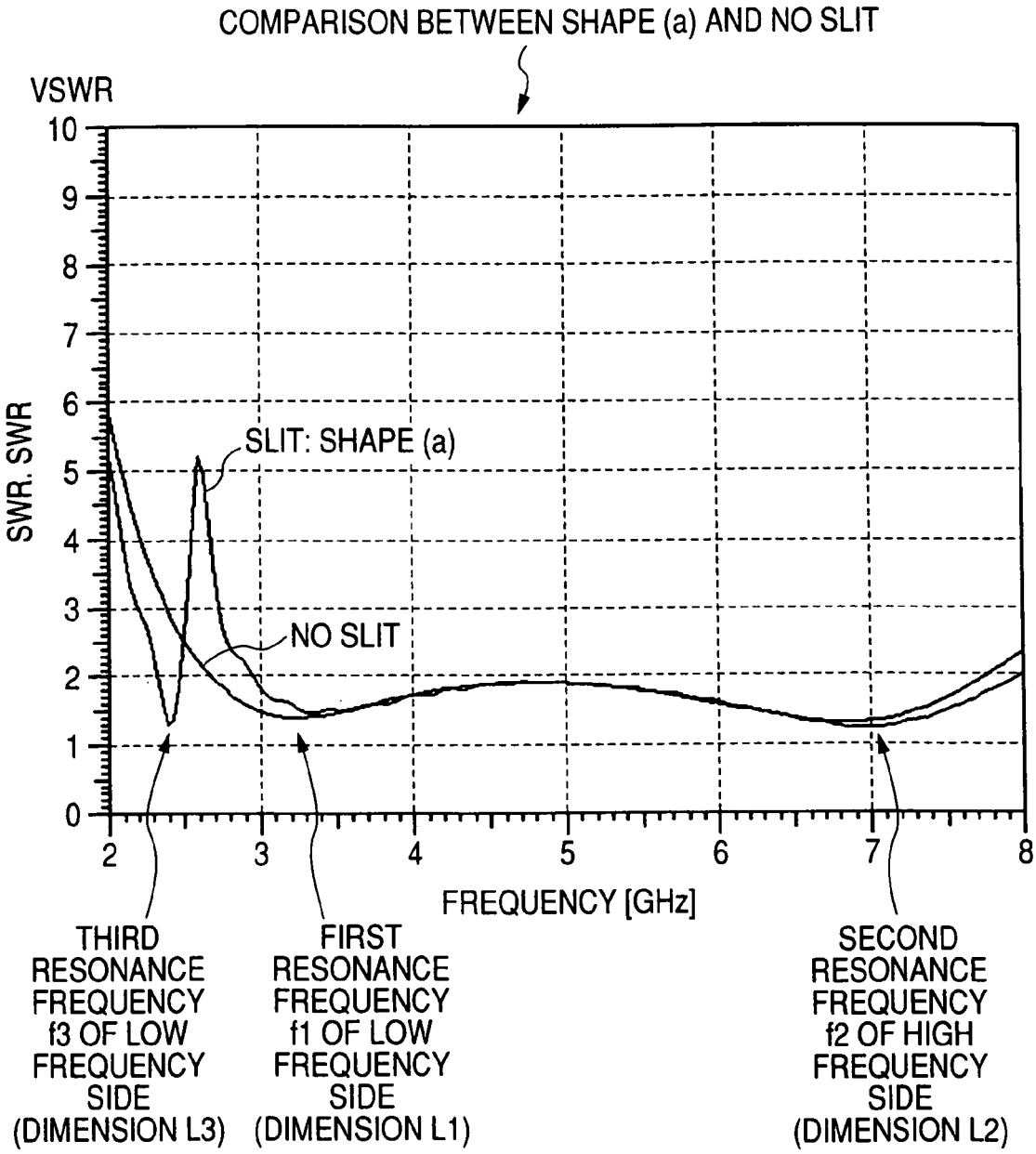
FIG. 2 is a graph showing a simulation result of a VSWR of the planar antenna shown in FIG. 1(*a*) according to the first embodiment.
Figure 3:
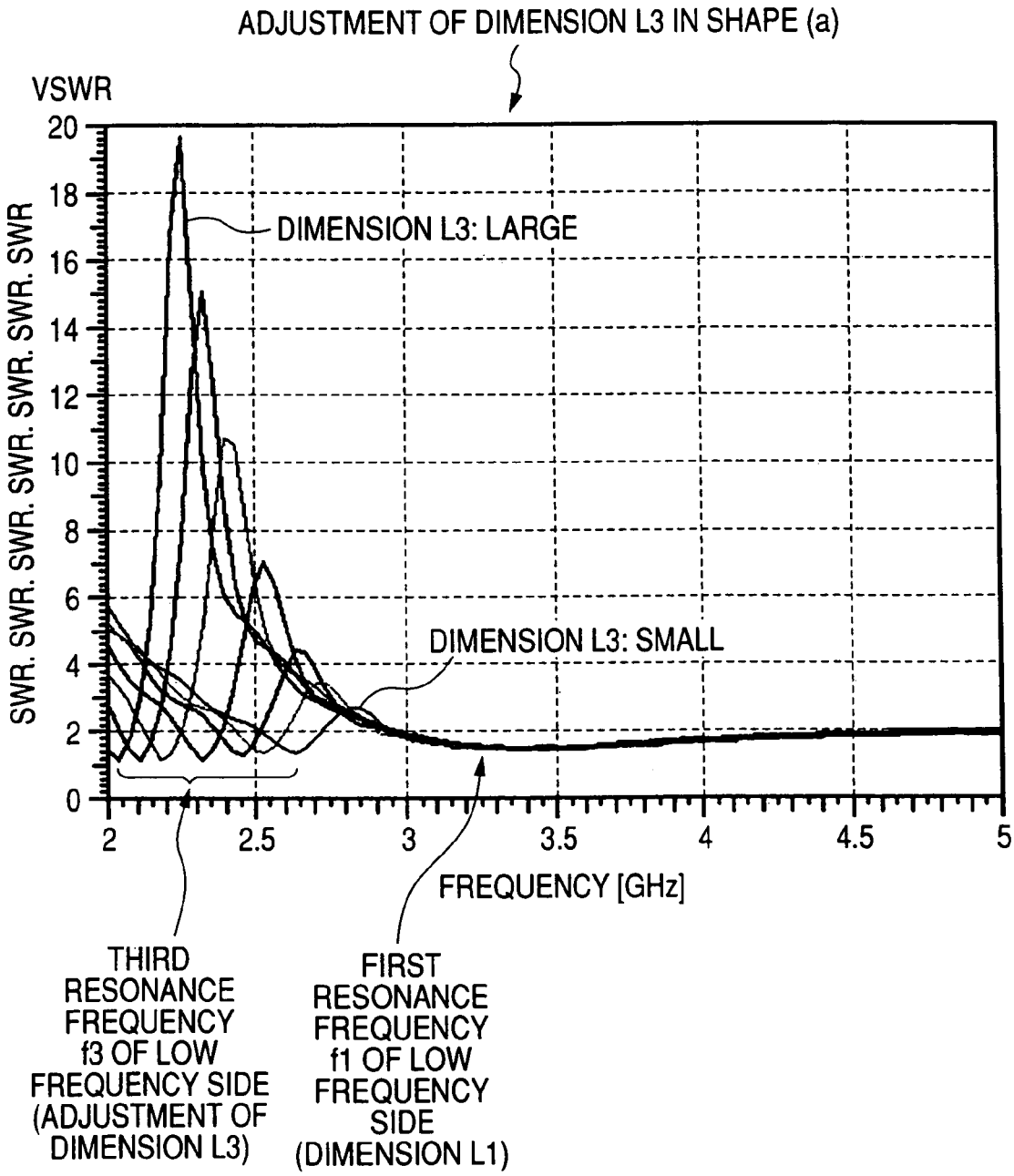
FIG. 3 is a graph showing a simulation result of the VSWR of the planar antenna shown in FIG. 1(*a*) according to the first embodiment (A dimension L1 is variable.)

A dimension L1 denoted by a dotted line is a dimension from the feeding point 3 to the end of the side 6 along the short side 4. The lengths of the side 6 and the side 7 may be different from each other. In this case, the dimension L1 is a dimension from the feeding point 3 to the end of the side having a larger length along the short side 4. The length of the short side 4 is denoted by a dimension L2. The relationship among the dimension L1, the dimension L2 and the resonance frequency will be described later (FIGS. 2 and 3).

Hereinafter, the shape of the slit 8 which is the characteristic of the first embodiment will be described with is reference to FIGS. 1(*a*), 1(*b*), 1(*c*), 1(*d*) and 1(*e*).

In FIG. 1(*a*), the slit 8 vertically extends from a closed end 8*a*, which is positioned in the vicinity of the feeding point 3, to the vicinity of the long side 5 and extends from the vicinity of the long side 5 parallel to the long side 5, and an opened side 8*b* is opened at the side 7. A dimension L3 denoted by a dotted line is a dimension from the feeding point 3 to the right upper end 1*a* of the trapezoid through the closed end 8*a* of the slit 8 and the opened end 8*b* along the slit 8. Since the opened end 8*b* and the right upper end 1*a* are adjacent to each other, the dimension L3 may be defined to the dimension from the feeding point 3 to the opened end 8*b* through the closed end 8*a* of the slit 8 along the slit 8.

In FIG. 1(*b*), the slit 8 extends in the vicinity of the long side 5 parallel to the long side 5. One end of the slit 8 is the closed end 8*a* and the other end thereof is the opened end 8*b* which is opened at the side 7. The dimension L3 denoted by a dotted line is a dimension from the feeding point 3 to the right upper side 1*a* of the trapezoid through the closed end 8*a* of the slit 8 and the opened end 8*b* along the slit 8, similar to FIG. 1(*a*). Since the opened end 8*b* and the right upper end 1*a* are adjacent to each other, the dimension L3 may be defined to the dimension from the feeding point 3 to the opened end 8*b* through the closed end 8*a* of the slit 8 along the slit 8.

In FIG. 1(*c*), the slit 8 extends from the closed end 8*a* which is positioned within the trapezoid in a left direction and vertically extends, and the opened end 8*b* is opened at the long side 5. The dimension L3 denoted by a dotted line is a dimension from the feeding point 3 to the opened end 8*b* through the closed end 8*a* of the slit 8 along the slit 8.

The slit 8 of FIG. 1(*d*) is substantially similar to that of FIG. 1(*a*) except that the right upper end 1*a* of the trapezoid further extends in a right direction of the long side 5. The dimension L3 denoted by a dotted line is a dimension from the feeding point 3 to the right upper end 1*a* of the trapezoid through the closed end 8*a* of the slit 8 and the opened end 8*b* along the slit 8. Since the opened end 8*b* and the right upper end 1*a* are separated from each other, the dimension L3 is defined to the dimension from the feeding point 3 to the right upper end 1*a*.

The slit 8 of FIG. 1(*e*) is similar to that of FIG. 1(*a*) except that a slit 9 is provided. The slit 9 vertically extends from a closed end 9*a*, which is positioned in the vicinity of the closed end 8*a*, to the long side 5 along a vertical portion of the slit 8, and an opened end 9*b* is opened at the long side 5. The dimension L3 denoted by a dotted line is a dimension from the feeding point 3 to the right upper end 1*a* of the trapezoid through the closed end 8*a* of the slit 8 and the opened end 8*b* along the slit 8, similar to FIG. 1(*a*). Since the opened end 8*b* and the right upper end 1*a* are adjacent to each other, the dimension L3 may be defined to the dimension from the feeding point 3 to the opened end 8*b* through the closed end 8*a* of the slit 8 along the slit 8.

Although the closed end 8*a* of the slit 8 is positioned in the vicinity of the feeding point 3 in FIGS. 1(*a*), 1(*d*) and 1(*e*), the closed end 8*a* may not be positioned in the vicinity of the feeding point 3. For example, the vertical portion from the closed end 8*a* of the slit 8 may be shifted in a horizontal direction. Accordingly, the dimension L3, that is, the dimension from the feeding point 3 to the right upper end 1*a* through the closed end 8*a* of the slit 8 and the opened end 8*b* along the slit 8, can be adjusted. Alternatively, the vertical portion from the closed end 8*a* may be sloped.

Although the short side 4, the side 6 and the side 7 of the trapezoid of the first radiation element 1 are straight lines, the coupling portion between the short side 4 and the side 6 and the coupling portion between the short side 4 and the side 7 may be curved without a singular point as shown.

Next, the performance of the antenna 100 will be described with reference to FIGS. 2 to 9.

FIG. 2 is a simulation view of a voltage standing wave ratio (VSWR) of the shape (a) of the antenna 100 (FIG. 1(*a*)) and shows comparison with a case where the slit 8 is not formed. The gap G between the first radiation element 1 and the second radiation element 2 is approximately equal to or less than a tenth of the dimension L2 of the short side 4.

The case where the slit is not formed corresponds to the disclosure in JP-A-2006-033069. The dimension L1 is approximately a fourth of the wavelength λ1 of the first resonance frequency f1 of a low frequency side. The dimension L2 of the short side 4 is approximately 0.3 to 0.4 times the wavelength λ2 of the second resonance frequency f2 of a high frequency side.

When the slit 8 of the present invention is formed, a third resonance frequency f3 is generated in the lower frequency side than the first resonance frequency f1 of the low frequency side, compared with the case where the slit is not formed. The first resonance frequency f1 of the low frequency side and the second resonance frequency f2 of the high frequency side are substantially similar those of the case where the slit is not formed. The relationship between the first resonance frequency f1 and the dimension L1 and the relationship between the second resonance frequency f2 and the dimension L2 are similar those of the case where the slit is not formed. The third resonance frequency f3 which is newly generated is related to the dimension L3 including the dimension of the slit 8. This relationship will be described later.

FIG. 3 is a simulation view of the VSWR of the shape (a) of the antenna 100, which simulates the relationship between the dimension L3 and the third resonance frequency f3 by varying the dimension L3. The dimension L3 varies by shifting the vertical portion from the closed end 8*a* of the slit 8 in the horizontal direction.

There are seven dimensions L3. The larger the dimension L3, the lower the third resonance frequency f3. Although the dimension L3 varies, the first resonance frequency f1 of the low frequency side and the second resonance frequency f2 of the high frequency side (not shown) do not vary. Even in any state, in the relationship between the dimension L3 and the third resonance frequency f3, the dimension L3 is approximately 0.2 to 0.3 times, that is, a fourth, of the wavelength λ3 of the third resonance frequency f3. As described with reference to FIG. 2, the dimension L1 is approximately a fourth of the wavelength λ1 of the first resonance frequency f1 of the low frequency side. Accordingly, when the dimension L3 including the dimension of the slit 8 is larger than the dimension L1, the third resonance frequency f3 can be generated in the lower frequency side than the first resonance frequency f1 of the low frequency side.

When the dimension L3 of the slit 8 varies, only the third resonance frequency f3 varies and the first resonance frequency f1 of the low frequency side and the second resonance frequency f2 of the high frequency side are not influenced. Accordingly, the third resonance frequency f3 can be independently controlled.

Figure 4:
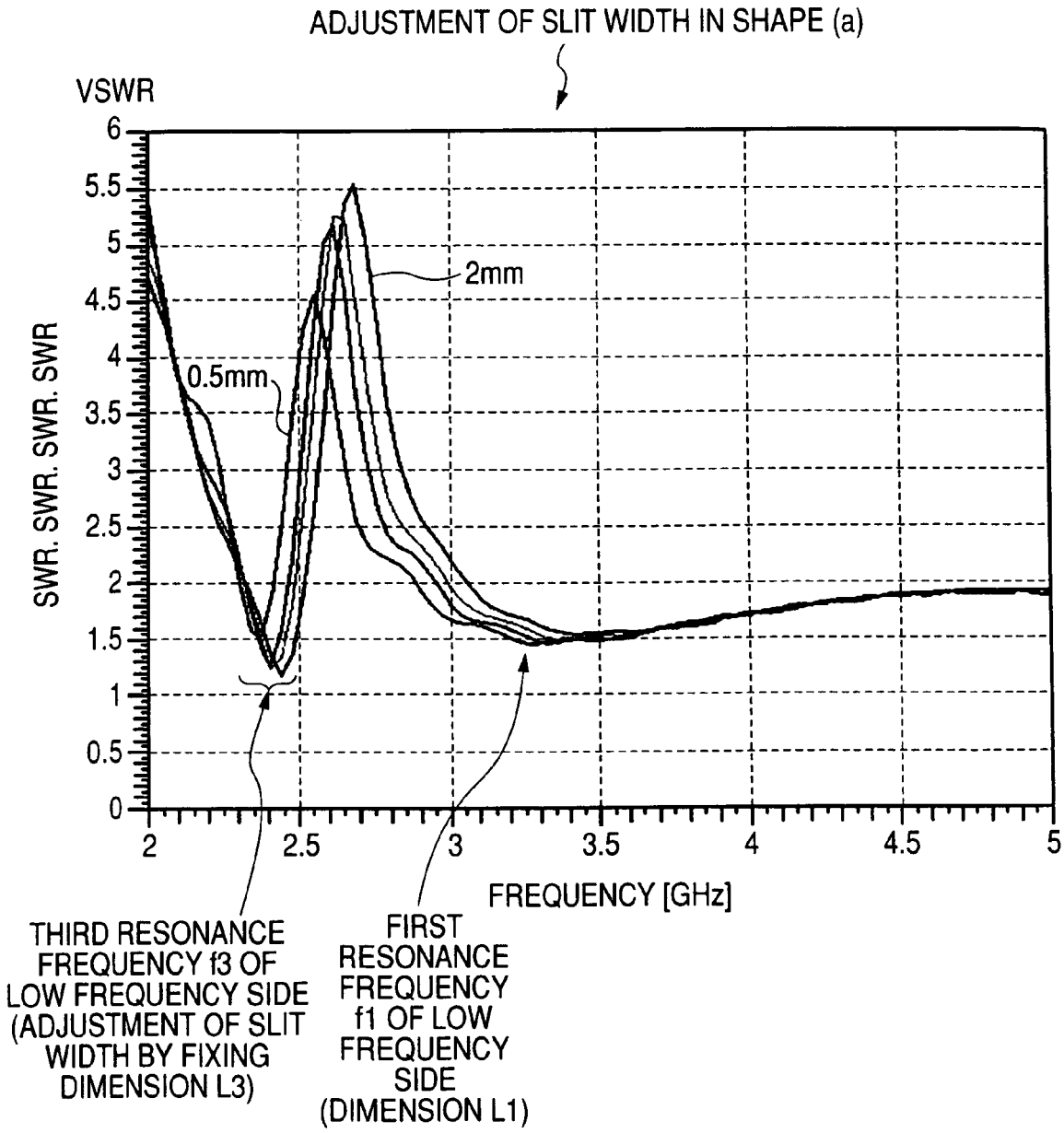
FIG. 4 is a graph showing a simulation result of the VSWR of the planar antenna shown in FIG. 1(*a*) according to the first embodiment (an influence of a slit width)

FIG. 4 is a simulation view of the VSWR of the shape (a) of the antenna 100 which simulates the influence of the slit width of the slit 8. When the slit width varies from 0.5 mm to 2 mm, the third resonance frequency f3 slightly varies and is substantially ignorable. Accordingly, as described with reference to FIG. 3, the third resonance frequency f3 can be controlled by the dimension L3 of the slit 8.

FIG. 5 is a simulation view of a radiation pattern of a vertically polarized wave in the shape (a) of the antenna 100, which simulates the radiation pattern of the vertically polarized wave with respect to frequencies of 2 GHz, 3 GHz, 4 GHz and 5 GHz. Even in any case, the radiation pattern is uniform and a null state is not generated at a specific angle. That is, it can be seen that a uniform radiation pattern can be obtained in the wideband.

Figure 6:
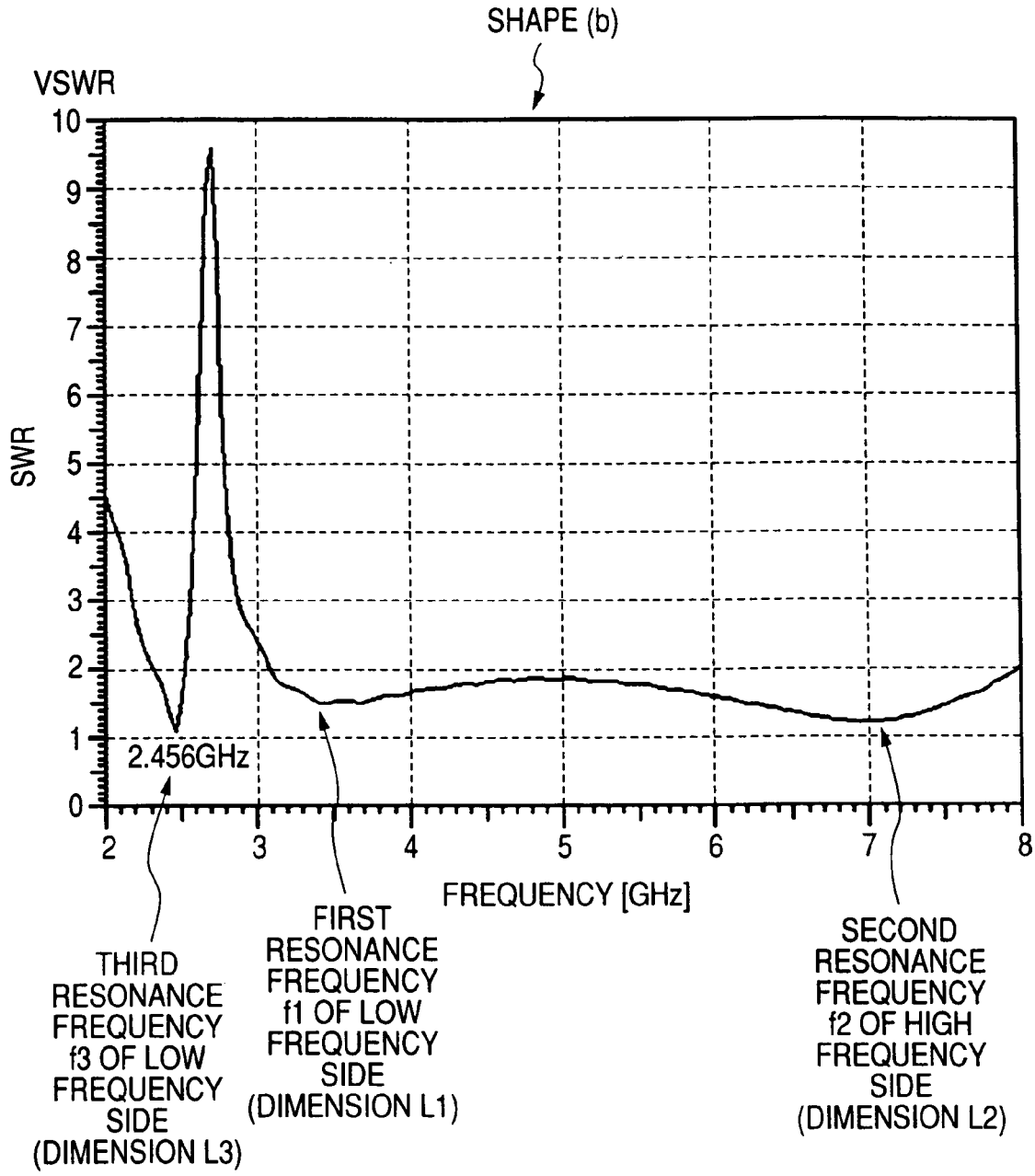
FIG. 6 is a graph showing a simulation result of a VSWR of the planar antenna shown in FIG. 1(*b*) according to the first embodiment.

FIG. 6 is a simulation view of the VSWR of the shape (b) of the antenna 100 (FIG. 1(*b*)). In this case, the same result as the shape (a) is obtained. The third resonance frequency f3 is generated at the lower frequency side than the first resonance frequency f1 of the low frequency side. The relationship between the dimension L3 of the slit 8 and the third resonance frequency f3 is similar to that of the shape (a) and thus their detailed description will be omitted.

Figure 7:
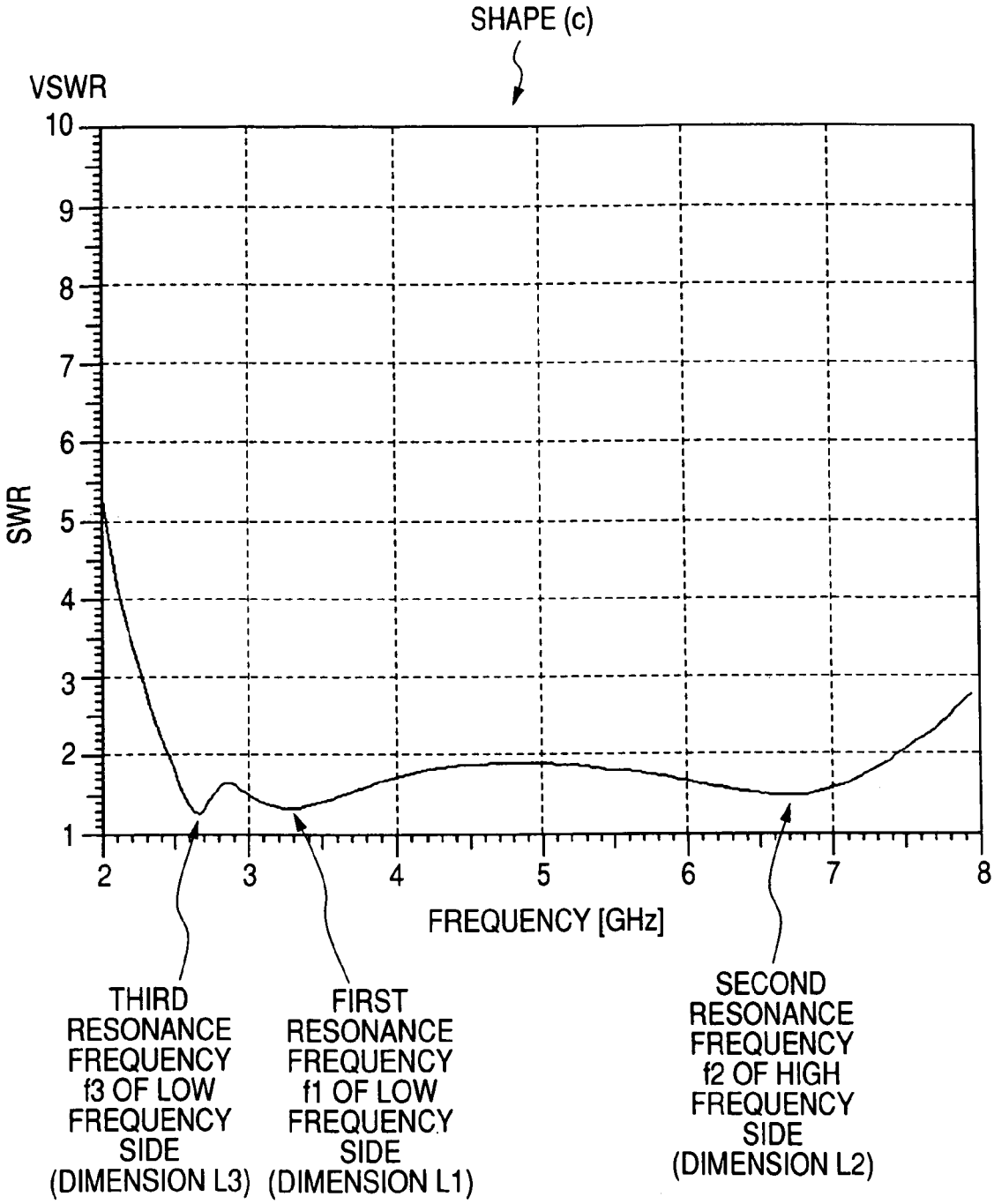
FIG. 7 is a simulation view of a VSWR of the planar antenna shown in FIG. 1(*c*) according to the first embodiment.

FIG. 7 is a simulation view of the VSWR of the shape (c) of the antenna 100 (FIG. 1(*c*)). In this case, the same result as the shape (a) is obtained. The third resonance frequency f3 is generated at the lower frequency side than the first resonance frequency f1 of the low frequency side. The relationship between the dimension L3 of the slit 8 and the third resonance frequency f3 is similar to that of the shape (a) and thus their detailed description will be omitted.

Figure 8:
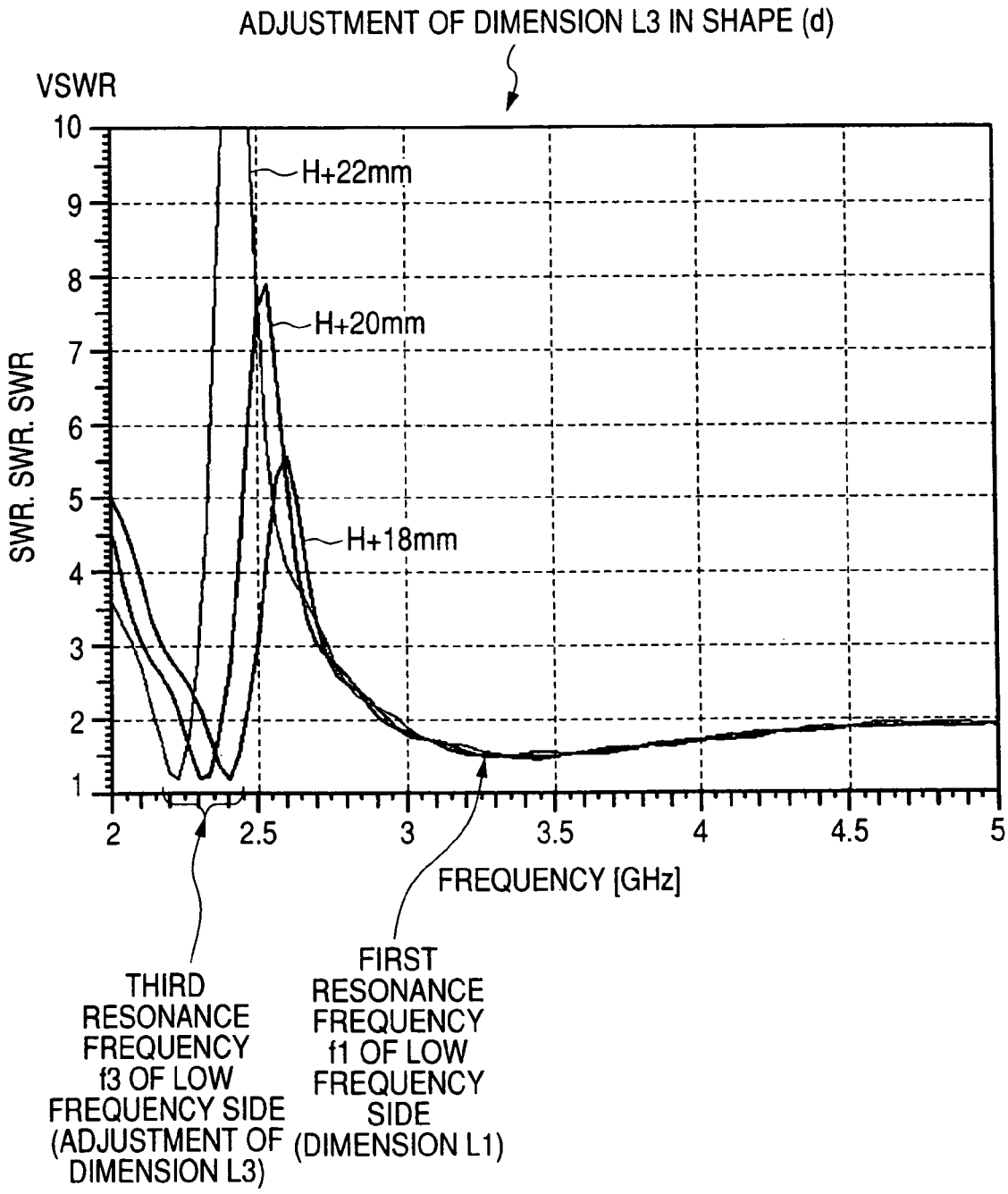
FIG. 8 is a simulation view of a VSWR of the planar antenna shown in FIG. 1(*d*) according to the first embodiment.

FIG. 8 is a simulation view of the VSWR of the shape (d) of the antenna 100 (FIG. 1(*d*)), which simulates the relationship between the dimension L3 and the third resonance frequency f3 by varying the dimension L3. The dimension L3 varies by extending the length of the long side 5 of the first radiation element 1 in the right direction and changing the position of the right upper end 1*a*. In Figure, "H+22 mm" or the like is the dimension L3. Here, a reference character H is the height of the slit 8 in the vertical direction and is fixed, and 22 mm, 20 mm and 18 mm are distances from the corner of the slit 8 to the right upper end 1*a*.

There are three dimensions L3. The larger the dimension L3, the lower the third resonance frequency f3. Even in any state, the first resonance frequency f1 of the low frequency side and the second resonance frequency f2 of the high frequency side (not shown) do not vary. Even in any state, in the relationship between the dimension L3 and the third resonance frequency f3, the dimension L3 is approximately 0.2 to 0.3 times the wavelength λ3 of the third resonance frequency f3.

Figure 9:
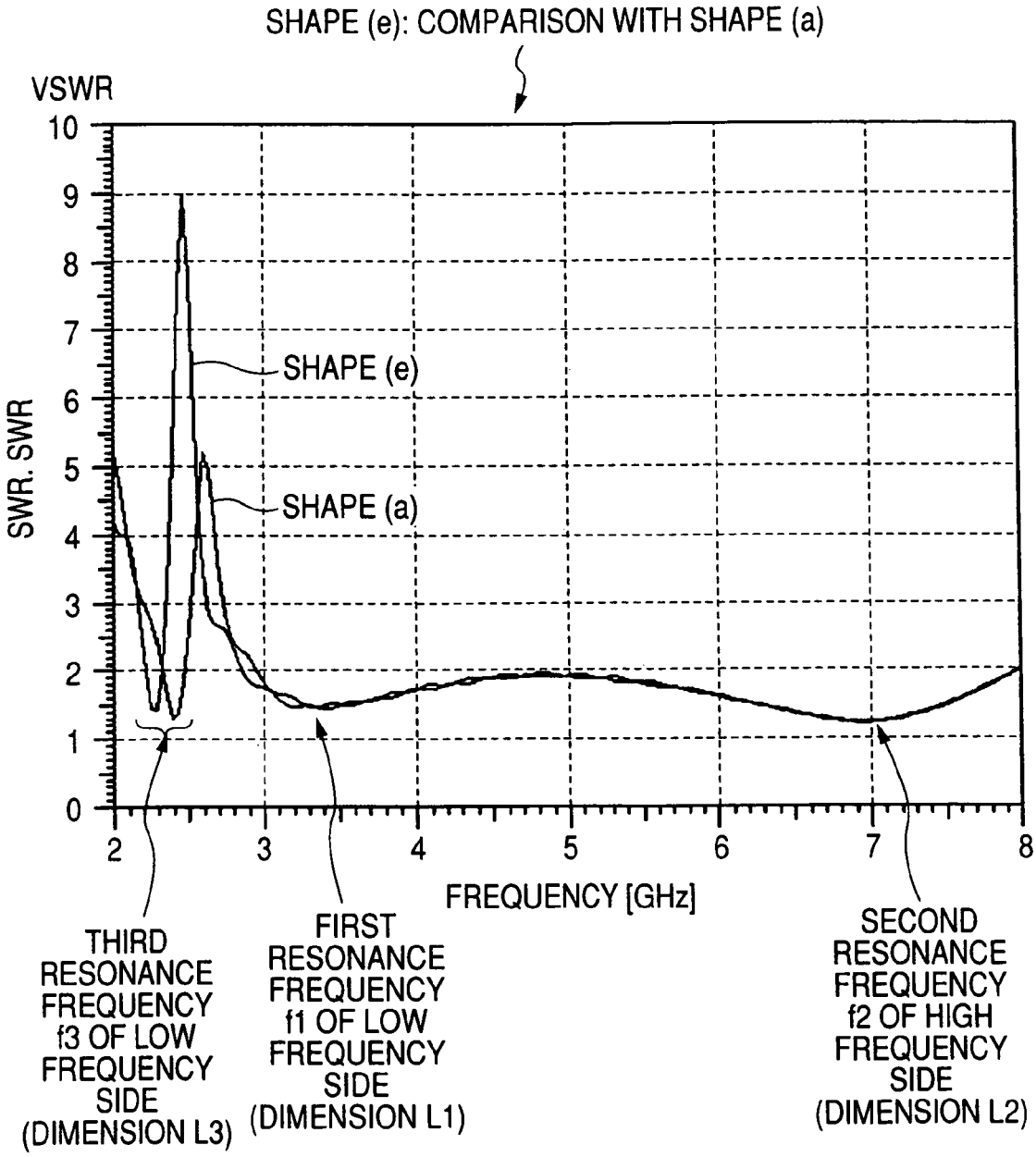
FIG. 9 is a simulation view of a VSWR of the planar antenna shown in FIG. 1(*e*) according to the first embodiment.

FIG. 9 is a simulation view of the VSWR of the shape (e) of the antenna 100 (FIG. 1(*e*)) and shows the comparison between the shape (e) and the shape (a) in a state that the dimension L3 of the slit 8 is fixed. The entire dimension of the first radiation element 1 of the shape (e) is equal to that of the shape (a), but the shape (e) further includes the slit 9. The third resonance frequency f3 of the shape (e) is lower than the third resonance frequency f3 of the shape (a). This is because a current distribution is further concentrated in the shape (e).

Next, a modified example of the first embodiment will be described.

Figure 10:
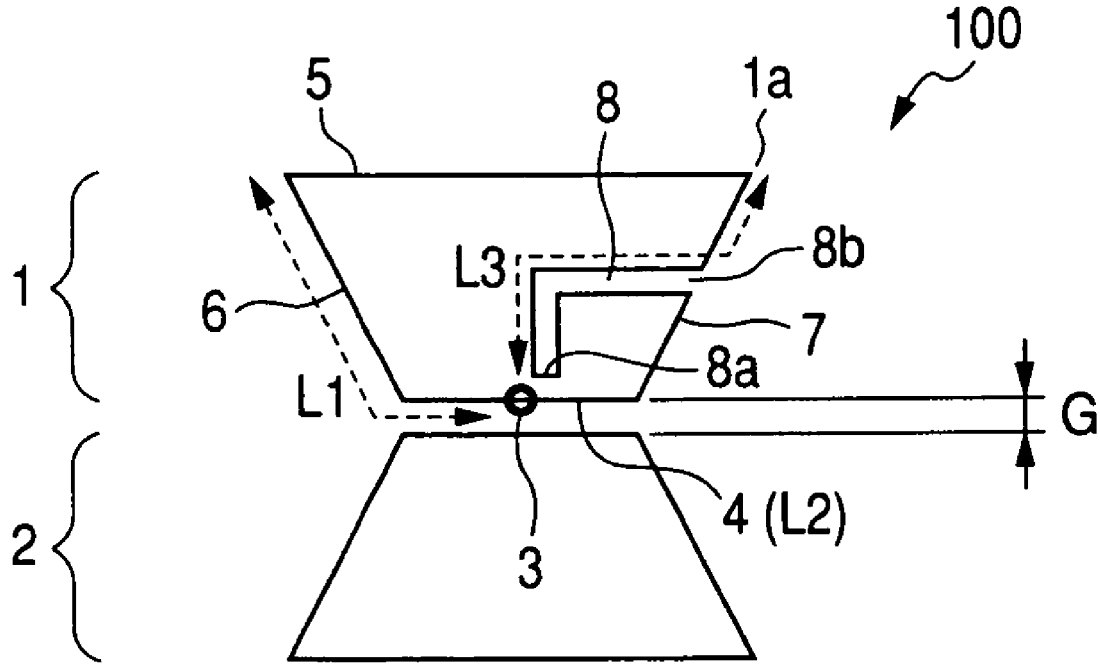
FIG. 10 is a view showing the configuration of a planar antenna according to a modified example of the first embodiment.

FIG. 10 shows a modified example of FIG. 1(*a*). While the slit 8 vertically extends from the closed end 8*a* to the vicinity of the long side 5 in FIG. 1(*a*), the slit 8 vertically extends from the closed end 8*a* to a middle portion and extends from the middle portion parallel to the long side 5 and the opened end 8*b* is opened at the side 7 in FIG. 10. The dimension L3 denoted by a dotted line is a dimension from the feeding point 3 to the right upper end 1*a* of the trapezoid through the closed end 8*a* of the slit 8 and the opened end 8*b* along the slit 8. The opened end 8*b* and the right upper end 1*a* are separated from each other.

Next, the performance of the antenna 100 will be described.

Figure 11:
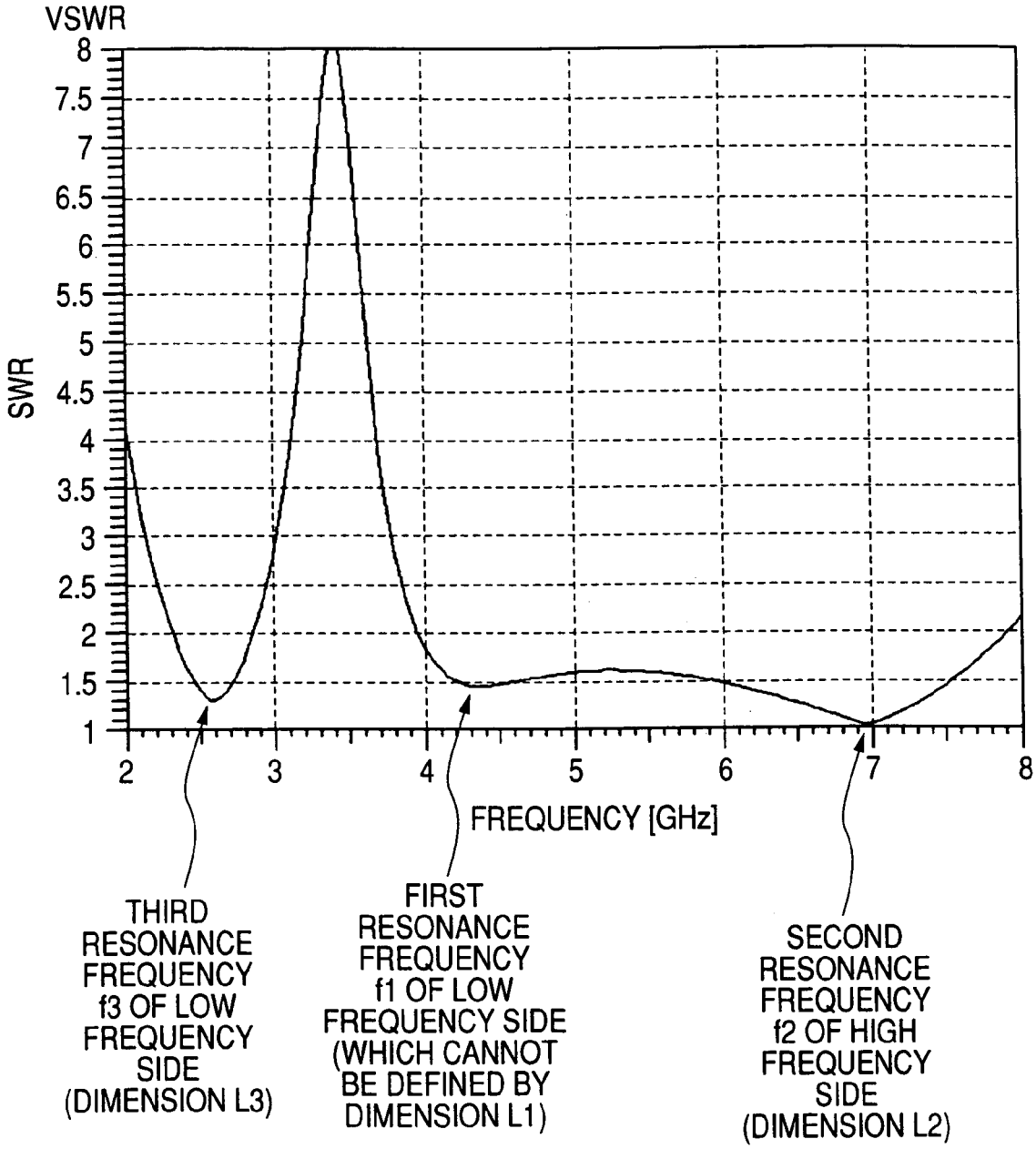
FIG. 11 is a simulation view of a VSWR of the planar antenna according to the modified example of the first embodiment.

FIG. 11 is a simulation view of the VSWR of the antenna 100 (FIG. 10). The third resonance frequency f3 can be generated in addition to the first resonance frequency f1 and the second resonance frequency f2. The third resonance frequency f3 is related to the dimension L3 including the dimension of the slit 8. The third resonance frequency f3 can be determined by adjusting the dimension L3.

However, the first resonance frequency f1 is shifted to the higher frequency side, compared with that of FIG. 2 showing the simulation view of FIG. 1(*a*). Accordingly, like FIG. 1(*a*), it is preferable that the horizontal portion of the slit 8 is disposed in the vicinity of the long side 5.

Although the first radiation element 1 and the second radiation element 2 are the trapezoid planes, a quadrangle plane such as a rectangle may be used.

According to the first embodiment of the present invention, since the slit is provided, it is possible to generate the third resonance frequency f3 at the low frequency side with the same dimension, compared with the case where the slit is not formed. When the dimension L3 of the slit 8 varies, only the third resonance frequency f3 varies and the first resonance frequency f1 of the low frequency side and the second resonance frequency f2 of the high frequency side are not influenced. Accordingly, the third resonance frequency f3 can be independently controlled.

Second Embodiment

A second embodiment improves a strength against bending.

Figure 12A:
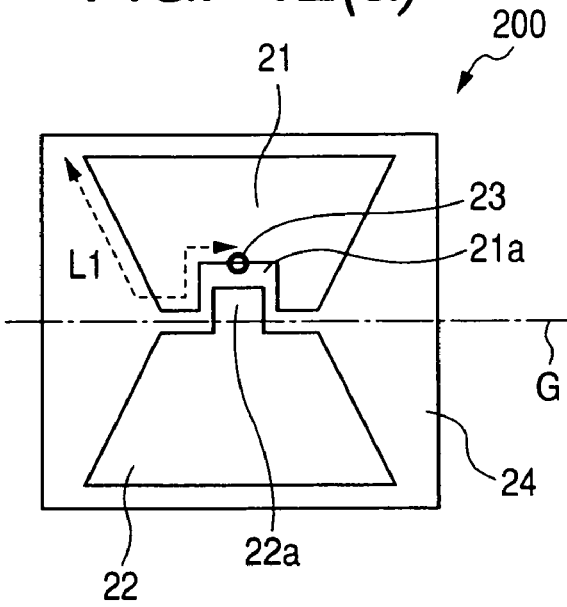
FIGS. 12(*a*)-(*c*) are views showing the configurations of planar antennas according to a second embodiment of the invention.
Figure 12B:
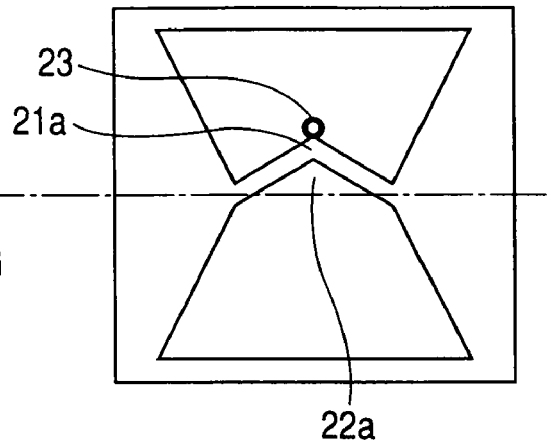
Figure 12C:
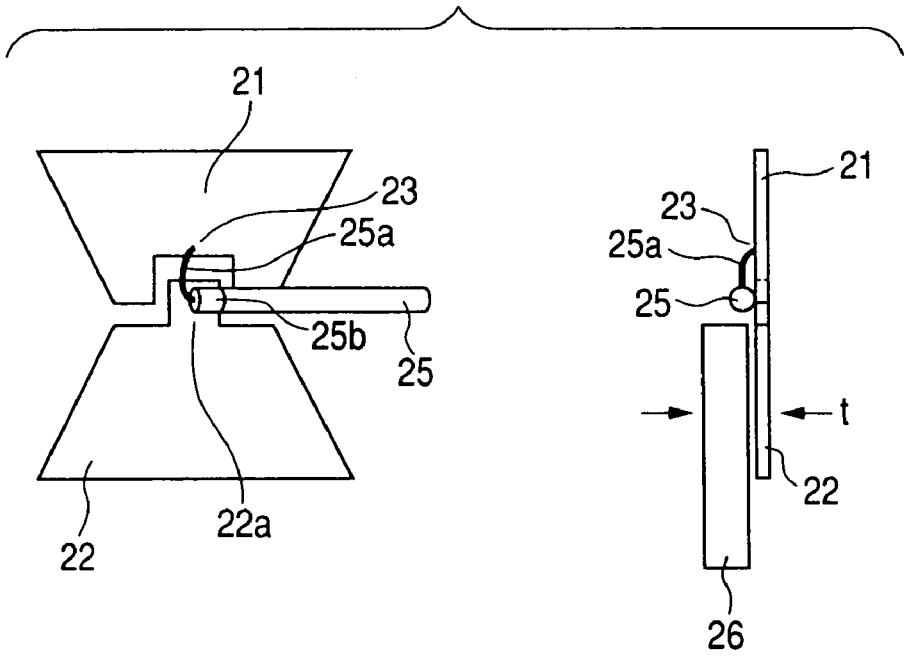

FIGS. 12(*a*) and (*b*) are views showing the configurations of dipole type planar antennas according to the second embodiment In FIGS. 12(*a*) and 12(*b*), an antenna 200 includes a first radiation element 21 formed of a copper plate, a second radiation element 22 formed of a copper plate and a feeding point 23. The first radiation element 21 and the second radiation element 22 are adhered to each other using polyimide resin 24. The first radiation element 21 has a notched concave portion 21*a* and the feeding point 23 is formed in the vicinity of the concave portion 21*a*. The second radiation element 22 has a convex portion 22*a* in conformity with the concave portion 21*a* of the first radiation element 21.

The convex portion 22*a* of the second radiation element 22 is formed on a dashed line of a gap G in which the first radiation element 21 and the second radiation element 22 face each other. Accordingly, it is possible to improve the strength against bending.

FIG. 12(*c*) shows a structure in which a coaxial cable 25 is attached to the antenna 200. A core wire 25*a* of the coaxial cable 25 is soldered to the feeding point 23. A GND 25*b* of the coaxial cable 25 is soldered to the convex portion 22*a* of the second radiation element 22 and the coaxial cable 25 extends in a horizontal direction. Accordingly, a main portion except the convex portion 22*a* of the second radiation element 22 does not overlap the coaxial cable 25. Thus, when a LCD 26 or the other substrate is mounted in a mobile wireless device having the antenna 200 mounted thereon, the total thickness of the antenna 200, the LCD 26 and so on can decrease.

The dimension L1 denoted by a dotted line of FIG. 12(*a*) is longer than the corresponding dimension of the antenna disclosed in JP-A-2006-033069. As described in the first embodiment, the first resonance frequency f1 of the low frequency side which is determined by the dimension L1 can decrease and the low frequency band can be covered. In a case where the first resonance frequency f1 may be equal to JP-A-2006-033069, it is possible to decrease the dimension of the antenna 200.

Although the first radiation element 21 and the second radiation element 22 are trapezoid planes in the second embodiment, a quadrangle plane such as a rectangle may be used.

According to the second embodiment of the present invention, it is possible to increase the strength of the planar antenna against bending. It is possible to decrease the thickness of a mobile wireless device in a state that a coaxial cable is attached. It is possible to cover a low frequency band.

What is claimed is:

1. A planar antenna comprising:

a first radiation element having a planar shape, the first radiation element including a first partial periphery, a third partial periphery, a fourth partial periphery, a fifth partial periphery, a feeding point positioned at a substantially center of the first partial periphery; and a second radiation element having a planar shape, the second radiation element including a second partial periphery having a length at least substantially equal to that of the first partial periphery;

wherein the first partial periphery and the second partial periphery face each other at a substantially uniform gap that is substantially equal to or less than a tenth of the length of the first partial periphery;

wherein the third partial periphery is substantially parallel to a straight line connecting both ends of the first partial periphery;

wherein the fourth partial periphery connects one end of the first partial periphery to one end of the third partial periphery;

wherein the fifth partial periphery connects the other end of the first partial periphery to the other end of the third partial periphery;

wherein the first radiation element includes a slit having an opened end and a closed end, the opened end opening at a periphery of the first radiation element other than the first partial periphery, the closed end closed within the first radiation element; and wherein a distance from the feeding point to the opened end along the slit through the closed end is longer than a distance obtained by adding a half of the length of the first partial periphery and a longer one of a length of the fourth partial periphery and a length of the fifth partial periphery.

2. The planar antenna according to claim 1, wherein the opened end is positioned in the vicinity of the third partial periphery.

3. A planar antenna comprising:

a first radiation element having a planar shape, the first radiation element including a first partial periphery, a third partial periphery, a fourth partial periphery, a fifth partial periphery, a feeding point positioned at a substantially center of the first partial periphery; and a second radiation element having a planar shape, the second radiation element including a second partial periphery having a length at least substantially equal to that of the first partial periphery;

wherein the first partial periphery and the second partial periphery face each other at a substantially uniform gap that is substantially equal to or less than a tenth of the length of the first partial periphery;

wherein the third partial periphery is substantially parallel to a straight line connecting both ends of the first partial periphery;

wherein the fourth partial periphery connects one end of the first partial periphery to one end of the third partial periphery;

wherein the fifth partial periphery connects the other end of the first partial periphery to the other end of the third partial periphery;

wherein the first radiation element includes a slit having an opened end and a closed end, the opened end opening at a periphery of the first radiation element other than the first partial periphery, the closed end closed within the first radiation element;

wherein a distance from the feeding point to the one end of the third partial periphery through the closed end and the opened end along the slit is longer than a distance obtained by adding a half of the first partial periphery and a longer one of a length of the fourth partial periphery and a length of the fifth partial periphery; and wherein the one end of the third partial periphery is positioned at a side of the opened end.

4. A planar antenna comprising:

a first radiation element having a planar shape, the first radiation element including a first partial periphery, a third partial periphery, a fourth partial periphery, a fifth partial periphery, a feeding point positioned at a substantially center of the first partial periphery; and a second radiation element having a planar shape, the second radiation element including a second partial periphery having a length at least substantially equal to that of the first partial periphery;

wherein the first partial periphery and the second partial periphery face each other at a substantially uniform gap that is substantially equal to or less than a tenth of the length of the first partial periphery;

wherein the third partial periphery is substantially parallel to a straight line connecting both ends of the first partial periphery;

wherein the fourth partial periphery connects one end of the first partial periphery to one end of the third partial periphery;

wherein the fifth partial periphery connects the other end of the first partial periphery to the other end of the third partial periphery;

wherein the first radiation element includes a first slit and a second slit provided parallel to a portion of the first slit;

wherein the first slit has an opened end and a closed end, the opened end opening at a periphery of the first radiation element other than the first partial periphery, the closed end closed within the first radiation element; and wherein a distance from the feeding point to the opened end along the first slit through the closed end is longer than a distance obtained by adding a half of the length of the first partial periphery and a longer one of a length of the fourth partial periphery and a length of the fifth partial periphery.

5. The planar antenna according to claim 4, wherein the opened end is positioned in the vicinity of the third partial periphery.

* * * * *